United States Patent [19]

Mosseri et al.

[11] Patent Number: 4,790,759

[45] Date of Patent: Dec. 13, 1988

[54] EDUCATIONAL BUILDING GAME

[76] Inventors: Rémy Mosseri, 27, rue Jean Mermoz, 92700 Colombes; Jean-François Sadoc, 5, Place de Savoie, 91940 Les Ulis, both of France

[21] Appl. No.: 511,663

[22] Filed: Jul. 7, 1983

[30] Foreign Application Priority Data

Jul. 9, 1982 [FR] France ..... 82 12101

[51] Int. Cl.[4] ..... G09B 23/04

[52] U.S. Cl. ..... 434/403; 434/211; 273/157 R

[58] Field of Search ..... 434/211, 403, 278; 273/157 R

[56] References Cited

U.S. PATENT DOCUMENTS

| | | | |
|---|---|---|---|
| 595,782 | 12/1897 | Morsell | 434/211 |
| 1,472,536 | 10/1923 | Thomson | 434/403 |
| 2,839,841 | 6/1958 | Berry | 434/278 |
| 3,461,574 | 8/1969 | Larsen et al. | 434/403 |
| 3,564,735 | 2/1971 | Fisher | 434/403 |
| 3,645,535 | 2/1972 | Randolph | 273/157 R |
| 3,659,360 | 5/1972 | Zeischegg | 434/403 |
| 4,051,621 | 10/1977 | Hogan | 434/403 X |
| 4,258,479 | 3/1981 | Roane | 434/211 |
| 4,334,870 | 6/1982 | Roane | 434/403 X |
| 4,334,871 | 6/1982 | Roane | 434/211 |

*Primary Examiner*—William H. Grieb

*Attorney, Agent, or Firm*—Ladas & Parry

[57] ABSTRACT

An educational game which has predetermined polyhedral bodies. The dimensions of the edges of the polyhedral bodies are ratios substantially equal to 1 and to a whole power of $\tau$, with $$\tau = \frac{1+\sqrt{5}}{2} = 1{,}618.$$

This game also includes (a) at least one polyhedral body for defining a tetrahedral volume;

(b) at least one polyhedral body for defining a pyramidal hexahedral volume;

(c) at least one polyhedral body for defining a bipyramidal heptahedral volume; and (d) at least one polyhedral body for defining an octahedral volume.

The polyhedral bodies of the game allow a non-periodical filling of the space, the formation of homothetic volumes of the volumes and of regular dodecahedral volumes.

14 Claims, 2 Drawing Sheets

EDUCATIONAL BUILDING GAME

DESCRIPTIVE SUMMARY

The educational game comprises a set of polyhedra, all the edges of which are mutually in ratios equal to 1 or to a whole power of $\tau$ with $$\tau = \frac{1+\sqrt{5}}{2}$$

In a first embodiment the set comprises four basic forms (A, S, Z and H) that allow a non-periodical filling in of the space, the formation of homothetic volumes of said volumes (A, S, Z and H) and of regular dodecahedral volumes.

In a second embodiment the set comprises six tetrahedral basic forms (B, C, D, E, F and G) obtained by cutting the four preceding basic forms.

This invention concerns itself with an educational game that comprises a set of elementary pieces having a limited number of predetermined shapes and allowing, by different groupings of the pieces, the formation of a certain number of remarkable geometrical figures.

There have already been proposed games of that kind where the pieces, flat, thus allow the formation of known polygons or also of reproductions of elementary pieces in a larger scale. It is possible thus to arrive at a filling in or paving of the surface in a manner that is periodical (that is, where it is possible to find one piece or set of pieces that allows covering the surface just by translations) or non-periodical (where it is necessary to effect rotations or inversions).

However, these games that permit paving of the surface have a limited educational nature, taking into account the relative easiness of grouping the pieces by examining their shapes and visually searching the homologous outlines. The filling in of the surface is deduced without difficulty by reiterating the same basic sequence.

There have likewise been proposed three-dimensional games in which the purpose is to form a given volume, mainly a polyhedral volume, starting from a certain number of elementary pieces. But these games lend themselves only to the formation of a limited number of given volumes, often a single volume, due to the narrow specificity of the shapes of the elementary pieces with respect to the shape of the final volume desired. Said specificity often simplifies the formation, since it is easier to recognize in one or the other piece a vertex, an edge, . . . of the final volume.

The possibility of a non-periodical filling of the space starting from a limited number of pieces has been recently recognized. But these searches had not hitherto made it possible to arrive at elementary shapes that are sufficiently simple and in a sufficiently reduced number to allow the obtention of an educational game.

This is why the invention proposes a game where the dimensions of the edges of the polyhedral bodies are mutually in ratios equal to 1 or to a whole power of $\tau$ with $$\tau = \frac{1+\sqrt{5}}{2},$$

this game comprising:

(a) at least one polyhedral body for defining a tetrahedral volume A such as defined herebelow, (b) at least one polyhedral body for defining a pyramidal hexahedral volume S such as defined herebelow, (c) at least one polyhedral body for defining a bipyramidal heptahedral volume Z such as defined herebelow, (d) at least one polyhedral body for defining an octahedral volume H such as defined herebelow, said polyhedral bodies allowing a non-periodical filling of the space, the formation of homothetic volumes of said volumes A, S, Z, H and of regular dodecahedral volumes.

In a first embodiment, each one of the A, S, Z, H volumes is defined by a single polyhedral body, the game comprising then four basic forms.

In a second embodiment, at least one of the A, S, Z, H volumes is defined by several polyhedral bodies that are all tetrahedra. It will be seen below that since each of the volumes is thus decomposed in tetrahedra, the game can then include 6 basic forms.

In this manner, with a limited number of volumes, for instance, 4 or 6, it is possible to form a certain number of regular polyhedra or to effect a non-periodical filling of the space, which allows a very great variety in the use of the game.

Different means can be envisaged for assembling the different pieces of the game: it is possible, for instance, to provide a hollow receptacle having the internal dimensions of the polyhedron to be formed; it is likewise possible to provide on the faces of the pieces fastening means that allows the integration of the face of another piece.

Other characteristics and details will appear when reading herebelow the detailed description given with reference to the appended drawings, wherein.

Figure 1:
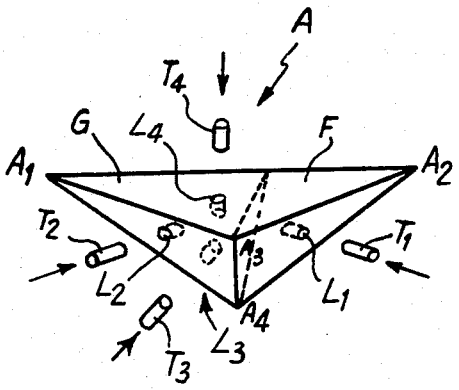
FIGS. 1 to 4 are perspective views of the four volumes A, S, Z and H, respectively.

In FIG. 1 the volume A has been shown provided with its assembly means; for the sake of clarity of the drawings, said means has not been shown in the other Figures, but it must be well understood that said means is not specific of volume A and is found on the faces of all the other volumes that constitute the pieces of the game.

The assembly means that have been shown consist of joining spindles $T_1$ to $T_4$ that can be introduced into the bores $L_1$ to $L_4$ made on each one of the faces of the tetrahedral volume A.

The bore is preferably made in a single point of each face of the volume. One of the properties of the game is in fact that it is always possible to find on each face a remarkable point that will always coincide with the remarkable point of the face in contact of the other volume assembled with the first. (When the game is composed of the B to G tetrahedra, the remarkable point is the barycenter of each one of the triangles that form the faces). A single bore made in the faces is then sufficient for permitting the assemblage in all the different figures.

As a variation, it is possible to replace the bore-spindle combination by a recess made on the face of the volume and cooperating with one assembly piece introduced in the recess, it being possible to introduce the assembly piece only in two privileged positions, the transit from one position to the other being accomplished by a 90° rotation. This makes it possible to give to the assembly piece, according to its position, indifferently a "male" or "female" character for each face in contact. By virtue of this manner of assembling the pieces, an immediate alignment of the edges of the faces in contact is ensured, while preventing any relative rotation of the faces, as is the case in the assembly by means of spindles.

Another mode of assembly consists in an adhesive coating applied to the face of the different volumes: it is possible to use to this effect adhesive coatings known per se, which, alone, have only a weak adhesiveness (which specially prevents inconveniences when manipulating with the fingers) while ensuring a satisfactory attachment when two adherent faces are brought into contact. But this adherent power must be sufficiently reduced to permit an easy separation of the different pieces.

Another mode of assembly of the pieces consists in providing a hollow receptacle having the inner dimensions of the polyhedron to be formed, for example, a regular dodecahedron. This receptacle opens for permitting the introduction by the user of the different pieces of the game.

The hollow receptacle is preferably reconstructed from a developed mold: there is thus furnished to the user a pre-cut flat mold that it will be enough to fold up in an appropriate way for obtaining, for instance, the hollow dodecahedron.

Now will be described the different pieces of the game: Piece A is a tetrahedral volume in which the edges have the following proportions:

$$A_1A_2=\tau^2=1+\tau$$

$$A_1A_3=A_1A_4=A_2A_3=A_2A_4=\tau$$

$$A_3A_4=1$$

$\tau$ is the golden number $$\frac{1+\sqrt{5}}{2}=1{,}618,$$

approximately (an arbitrary dimension has been selected as unit of length, the only important point being the ratios of the dimensions between the different sides of the polyhedra).

Figure 2:
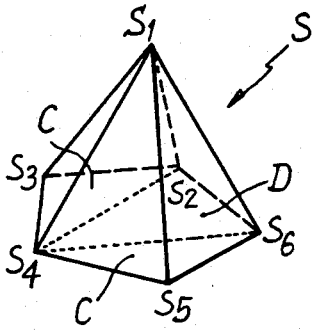

Volume S is a pyramid having a regular pentagonal base (FIG. 2); the sides of the pentagon have all a length 1 and the edges that join the vertex $S_1$ to the vertices of the pentagon have all a length $\tau$.

Figure 3:
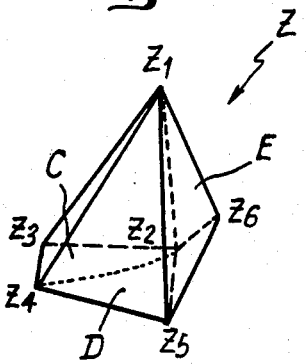

Heptahedral volume Z (FIG. 3) is a bipyramidal volume: it includes a first pyramid formed on a trapeze $Z_2$ $Z_3$ $Z_4$ $Z_5$ and a second pyramid of triangular base formed on one of the faces $Z_1$ $Z_2$ $Z_5$ of the first pyramid. The dimensions of the edges are the following:

$$Z_1Z_2=Z_1Z_3=Z_1Z_4=Z_1Z_5=\tau$$

$$Z_2Z_3=Z_3Z_4=Z_4Z_5=1$$

$$Z_6Z_1=Z_6Z_2=Z_6Z_5=1$$

$$Z_2Z_5=\tau$$

Figure 4:
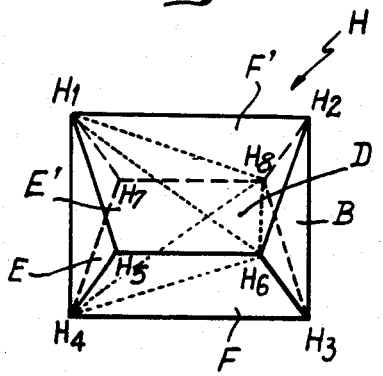
Figure 5:
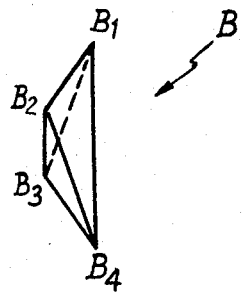
FIGS. 5 to 10 are perspective views of the tetrahedra B, C, D, E, F, G, respectively.
Figure 6:
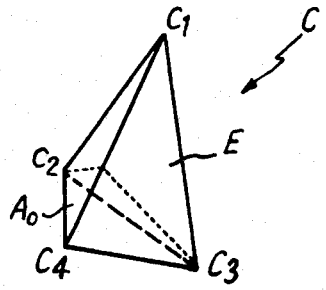
Figure 7:
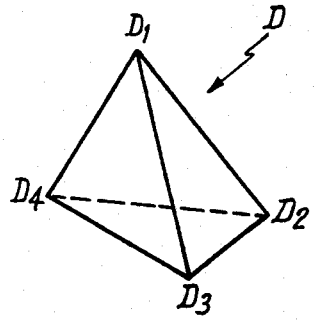

Volume H (FIG. 4) is an octahedral volume having the following dimensions:

$$H_1H_2=H_2H_3=H_3H_4=H_4H_1=\tau$$

$$H_1H_7=H_1H_5=1$$

$$H_2H_8=H_2H_6=1$$

$$H_3H_8=H_3H_6=1$$

$$H_4H_7=H_4H_5=1$$

It must ne observed that in this volume the polygon $H_1$ $H_2$ $H_3$ $H_4$ is a square of side $\tau$, and the polygon $H_5$ $H_6$ $H_8$ $H_7$ is a square of side 1. Besides, all the opposite faces of this volume are parallel faces.

One of the results that can be obtained by the combination of these different pieces is the reproduction of replicas thereof in enlarged scale (the homothetic ratio then being $\tau$): the homothetic volume of A can thus be formed from two A volumes (marked A and A') and from a volume S; for this it suffices to join the faces that follow (preserving the symbolism of the figures for the designation of the different vertices):

$$A_2A_3A_4 \longleftrightarrow S_1S_3S_4$$

$$A'_1A'_3A'_4 \longleftrightarrow S_1S_2S_6$$

In the same manner, a homothetic volume of S can be generated from: two volumes A, one S, one H and one Z with the following face-assembly rules:

$$Z_2Z_3Z_4Z_5 \longleftrightarrow H_1H_2H_7H_8$$

$$A_1A_2A_4 \longleftrightarrow Z_1H_1H_4$$

$$A'_1A'_2A'_3 \longleftrightarrow Z_1H_3H_2$$

$$S_2S_3S_4S_5S_6 \longleftrightarrow H_1Z_6H_2H_5H_6$$

The homothetic volume of Z is generated in the same manner as the homothetic volume of S with the difference of the volume A' that is suppressed (the volume Z is in fact a truncated volume S).

The homothetic volume H is generated from: one volume H, two volumes Z (marked Z and Z'), two volumes S (marked S and S') and two volumes A (marked A and A') with the following face-assembly rules:

$$Z_2Z_3Z_4Z_5 \longleftrightarrow H_1H_2H_7H_8$$

$$S_2S_3S_4S_5S_6 \longleftrightarrow H_1Z_6H_2H_5H_6$$

$$Z'_2Z'_3Z'_4Z'_5 \longleftrightarrow H_3H_4H_5H_6$$

$$S'_2S'_3S'_4S'_5S'_6 \longleftrightarrow H_3Z'_6H_4H_7H_8$$

$$S_1S_4S_5 \longleftrightarrow A_1A_3A_4$$

$$Z'_1Z'_3Z'_4 \longleftrightarrow A_2A_3A_4$$

$$Z_1Z_3Z_4 \longleftrightarrow A'_1A'_3A'_4$$

$$S'_1S'_4S'_5 \longleftrightarrow A'_2A'_3A'_4$$

By means of similar assemblies it is likwise possible to form a regular pentagonal dodecahedron (of edge unit) from four volumes A, four Z and three H.

For a homothetic dodecahedron (of edge $\tau$) of the above, it is sufficient to replace each one of the four pieces by the corresponding homothetic volume, which results, with the proportions indicated before, in a game including: eighteen volumes A, fourteen S, ten Z and seven H.

Figure 8:
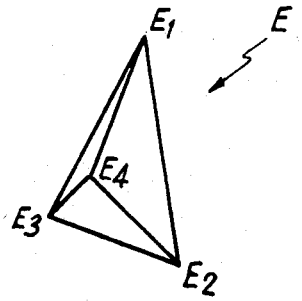
Figure 9:
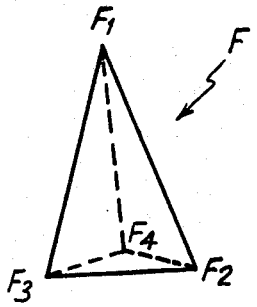
Figure 10:
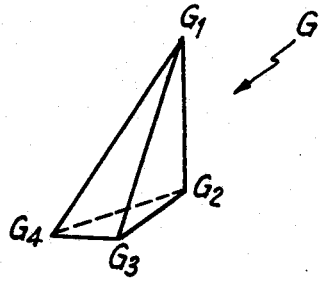

It is also possible, with the preceding game, to obtain a concave regular icosahedron. If to the four preceding pieces there are added the tetrahedra E (FIG. 8, which will be explained below), it is likewise possible to obtain a convex regular icosahedron, the pieces E allowing the "filling in" of the concavities of the concave icosahedron obtained before.

FIGS. 5 to 10 show a combination of six elementary pieces, all tetrahedral, that can be obtained by cutting the preceding four volumes A, S, Z, H. These tetrahedra lead, therefore, to the same results as those obtained with the combination of the four preceding pieces.

The dimensions of the edges of these tetrahedra are all 1 or $\tau$.

Tetrahedron B (FIG. 5) has a single edge $B_1B_4$ of a length $\tau$, all the other edges being of the unit length.

Tetrahedron C (FIG. 6) has four edges of $\tau$ length and two of unit length $C_2C_4$ and $C_3C_4$).

Tetrahedron D (FIG. 7) has all the edges of $\tau$ length except the edge $D_2D_3$ that is of unit length.

Tetrahedron E (FIG. 8) has three edges of $\tau$ length ($E_1E_2$, $E_2E_3$ and $E_3E_1$) arranged so as to form an equilateral triangle; the other edges are of unit length.

Tetrahedron F (FIG. 9) has three edges of $\tau$ length ($F_1F_2$, $F_1F_3$ and $F_1F_4$) issuing from the same vertex; the other edges are all of unit length.

Tetrahedron G (FIG. 10) has two edges of $\tau$ length ($G_1G_3$ and $G_1G_4$) issuing from the same vertex; the other edges are all of unit length.

It is to be observed that the tetrahedron C can be replaced by a tetrahedron E to which there would have been attached against one of the faces including the vertex $E_4$, for example, the face $E_2E_3E_4$, a tetrahedron $A_0$ homothetic of tetrahedron A defined above with a ratio $1/\tau$, that is, said tetrahedron $A_0$ will have as length of the sides $1/\tau$, 1 and $\tau$. This cutting of the tetrahedron C has been shown by a dotted line in FIG. 6.

To form the volumes A, S, Z, H, the tetrahedra B to G are assembled in the following manner (the cutting of the volumes A, S, Z, H has been indicated in dotted lines in FIGS. 1 to 4):

volume A is obtained from a tetrahedron F and a tetrahedron G by applying the face $F_2F_3F_4$ against the face $G_2G_3G_4$ (always preserving the designations of the vertices indicated in the Figures);

volume S is obtained from: one D and two C, with the following face assemblies:

$$C_1C_2C_3 \longleftrightarrow D_1D_3D_4$$

$$C'_1C'_2C'_3 \longleftrightarrow D_1D_2D_4$$

volume Z is obtained from: one D, one C and one E with the following rules:

$$C_1C_2C_3 \longleftrightarrow D_1D_3D_4$$

$$E_1E_2E_3 \longleftrightarrow D_1D_2D_4$$

volume H is obtained from: one D, two E, two S and one B with the following rules:

$$E_1E_2E_3 \longleftrightarrow D_1D_3D_4$$

$$E'_1E'_2E'_3 \longleftrightarrow D_1D_2D_4$$

$$F_1F_2F_3 \longleftrightarrow D_1D_2D_3$$

$$F'_1F'_2F'_3 \longleftrightarrow D_4D_2D_3$$

$$B_1B_2B_3 \longleftrightarrow D_2D_3F_4$$

$$B_2B_3B_4 \longleftrightarrow D_2D_3F'_4$$

The arrangement and presentation of the game can be improved by providing that one or several polyhedral bodies be hollow and possess a detachable face so as to house in the interior, at least partly, another polyhedral body. By thus wholly or partly encasing the different pieces there is reduced the encumbrance of collecting the pieces when they are put away without being assembled.

What is claimed is:

1. An educational game comprising predetermined polyhedral bodies, characterized, in combination, by the fact that the dimensions of the edges of the polyhedral bodies are mutually in ratios equal to 1 or to a whole power of $\tau$, with $$\tau = \frac{1+\sqrt{5}}{2} = 1{,}618,$$

approximately, and by the fact that it comprises:

(a) at least one polyhedral body for defining a tetrahedral volume A, (b) at least one polyhedral body for defining a pyramidal hexahedral volume S, (c) at least one polyhedral body for defining a bipyramidal heptahedral volume Z, (d) at least one polyhedral body for defining an octahedral volume H, said polyhedral bodies allowing a non-periodical filling of the space, the formation of homothetic volumes of said volumes A, S, Z, H and of regular dodecahedral volumes.

2. An education game according to claim 1, characterized by the fact that each said volume A, S, Z, H is defined by a single polyhedral body, said game comprising then four basic forms.

3. An educational game according to claim 2, characterized by the fact that it comprises in addition at least one polyhedral body for defining a supplementary tetrahedral volume E, allowing the formation of regular convex icosahedral volumes.

4. An educational game according to claim 1, characterized by the fact that at least one said volume A, S, Z, H is defined by several polyhedral bodies, all of which are tetrahedra.

5. An educational game according to claim 1, characterized by the fact that each said volume A, S, Z, H is defined by several polyhedral bodies, all of which are tetrahedra.

6. An educational game according to claim 1 or 2, characterized by the fact that said game comprises tetrahedra B, C, D, E, F, H, said game further comprising six basic forms.

7. An educational game according to claim 1 or 2, characterized by the fact that it includes in addition a hollow receptacle having the internal dimensions of the polyhedron to be formed.

8. An educational game according to claim 7, characterized by the fact that said hollow receptacle is formed from a developed form.

9. An educational game according to claim 1 or 2, characterized by the fact that at least one face of each polyhedral body includes fastening means that allows the integration with one face of another polyhedral body likewise including fastening means.

10. An educational game according to claim 9, characterized by the fact that said fastening means consists of an adhesive coating on at least one zone of the face of said polyhedral body.

11. An educational game according to claim 9, characterized by the fact that said fastening means consists of a bore made on the face of said polyhedral body in cooperation with an assembly spindle introduced into said bore and of a bore made on the corresponding face of the other polyhedral body.

12. An educational game according to claim 11, characterized by the fact that said bore is made in a single point of the face of said polyhedral body.

13. An educational game according to claim 9, characterized by the fact that said fastening means consists of a recess made on the face of said polyhedral body in cooperation with an assembly piece introduced into said recess and of the recess made on the corresponding face of the other polyhedral body, it being possible to introduce said assembly piece in one and the other recess only according to two defined positions, the transit from one position to the other being accomplished by a 90° rotation.

14. An educational game according to claim 1 or 2, characterized by the fact that at least one of said polyhedral bodies is hollow and has a detachable face so as to accommodate in the interior of said body, at least partly, another polyhedral body.

* * * * *